US010537181B2

(12) United States Patent
Brodbeck

(10) Patent No.: US 10,537,181 B2
(45) Date of Patent: Jan. 21, 2020

(54) CHAIR

(71) Applicant: Stefan Brodbeck, Munich (DE)

(72) Inventor: Stefan Brodbeck, Munich (DE)

( * ) Notice: Subject to any disclaimer, the term of this patent is extended or adjusted under 35 U.S.C. 154(b) by 0 days.

(21) Appl. No.: 14/965,192

(22) Filed: Dec. 10, 2015

(65) Prior Publication Data

US 2016/0095443 A1 Apr. 7, 2016

Related U.S. Application Data

(63) Continuation of application No. PCT/DE2014/000299, filed on Jun. 12, 2014.

(30) Foreign Application Priority Data

Jun. 12, 2013 (DE) ..... 20 2013 005 282 U

(51) Int. Cl.

| | |
|---|---|
| ***A47C 7/44*** | (2006.01) |
| ***A47C 1/024*** | (2006.01) |
| ***A47C 1/032*** | (2006.01) |
| ***A47C 7/40*** | (2006.01) |

(52) U.S. Cl.

CPC ..... *A47C 7/44* (2013.01); *A47C 1/024* (2013.01); *A47C 1/032* (2013.01); *A47C 7/40* (2013.01); *A47C 7/402* (2013.01)

(58) Field of Classification Search

CPC ..... A47C 7/44; A47C 7/441; A47C 1/024; A47C 1/032

USPC ..... 297/314

See application file for complete search history.

(56) References Cited

U.S. PATENT DOCUMENTS

| | | | | | |
|---|---|---|---|---|---|
| 148,380 | A * | 3/1874 | Perrenet | 297/354.1 | |
| 1,717,020 | A * | 6/1929 | Ferris | A47C 7/44 297/358 | |
| 2,745,468 | A * | 5/1956 | Kramer | A47C 3/021 297/285 | |
| 2,796,920 | A * | 6/1957 | Cowles | A47C 7/448 248/632 | |
| 3,552,797 | A * | 1/1971 | D'Houdain | A47C 7/42 297/354.1 | |
| 3,934,930 | A * | 1/1976 | Sandham | A47C 7/445 297/291 | |
| 5,769,492 | A * | 6/1998 | Jensen | A47C 9/002 297/188.09 | |

(Continued)

FOREIGN PATENT DOCUMENTS

| | | | |
|---|---|---|---|
| EP | 2698078 | A1 | 2/2014 |
| JP | H119375 | A | 1/1999 |
| JP | 2006095144 | A | 4/2006 |

OTHER PUBLICATIONS

International Search Report from PCT/DE2014/000299, filed Jun. 12, 2014, dated Sep. 26, 2014.

*Primary Examiner* — Timothy J Brindley

(74) *Attorney, Agent, or Firm* — Venable LLP; Adam R. Hess; Elizabeth C. G. Gitlin

(57) ABSTRACT

The present invention relates to a chair having a subframe, a seat part supported thereon and having a seat surface and a backrest which is disposed in the region of an edge of the seat part at least approximately perpendicularly to the seat surface and contains a contact surface for the back of a person sitting on the chair, wherein the backrest is designed such that it can pivot laterally about a pivot spindle extending at least approximately perpendicularly to the contact surface of the backrest.

20 Claims, 2 Drawing Sheets

(56) References Cited

U.S. PATENT DOCUMENTS

| | | | | | |
|---|---|---|---|---|---|
| 6,019,422 | A * | 2/2000 | Taormino | B62J 1/04 | 297/195.1 |
| 6,116,687 | A * | 9/2000 | Vogtherr | A47C 7/448 | 297/291 |
| 7,100,983 | B1 * | 9/2006 | Gant | A47C 7/14 | 108/2 |
| 7,637,570 | B2 * | 12/2009 | Becker | A47C 7/28 | 297/312 |
| 7,775,601 | B2 * | 8/2010 | Wu | A47C 7/448 | 297/230.14 |
| 8,465,095 | B2 * | 6/2013 | Su | A47C 7/44 | 297/301.1 |
| 8,528,980 | B1 * | 9/2013 | Hsiao | A47C 7/46 | 297/284.4 |
| 2002/0043846 | A1 * | 4/2002 | Brauning | A47C 3/026 | 297/314 |
| 2009/0261642 | A1 * | 10/2009 | Dickie | A47C 7/446 | 297/314 |
| 2012/0256458 | A1 * | 10/2012 | Gehner | A47C 7/14 | 297/314 |
| 2014/0191550 | A1 * | 7/2014 | Katoh | B60N 2/48 | 297/337 |
| 2015/0343924 | A1 * | 12/2015 | Takeuchi | B60N 2/39 | 297/314 |
| 2016/0081478 | A1 * | 3/2016 | Ehrenleitner | A47C 3/18 | 297/314 |
| 2016/0235203 | A1 * | 8/2016 | Rechtien | A47C 1/024 | |
| 2018/0078812 | A1 * | 3/2018 | Harlow | A63B 21/1609 | |

* cited by examiner

CHAIR

RELATED APPLICATIONS

This Application is a Continuation application of International Application PCT/DE2014/000299, filed on Jun. 12, 2014, which in turn claims priority to German Patent Applications DE 20 2013 005 282.1, filed on Jun. 12, 2013, both of which are incorporated herein by reference in their entirety.

FIELD OF THE INVENTION

The present invention relates to a chair according to the preamble of claim 1 and to an actuation method therefor.

BACKGROUND OF THE INVENTION

A chair generally contains a subframe and a seat part supported thereon and having a seat surface and a backrest which is disposed in the region of an edge of the seat surface at least approximately perpendicularly to the seat surface, and a contact surface for the back of a person sitting on the chair.

In order to permit comfortable movements of the upper body of a person sitting on the chair, various mechanisms are provided for the backrest so that this backrest follows movements of the upper body within a preset extent. Mechanisms which permit backwards movement of the backrest against a return force are widely used especially in office chairs. Furthermore, a chair has become known in practice which has a backrest which can elastically deflect by means of an elastic element such as e.g. a rubber joint.

In chairs, a balance always has to be found between stability and support function on the one hand and comfort on the other. In particular, when sitting on a chair for long period as required by work, a chair in which the backrest also performs each movement of a person sitting thereon with or without a counterforce is no more optimal than a chair with a backrest which is positioned in an entirely rigid manner. Furthermore, complex mechanisms for backrest moveability make chairs extremely expensive so that many users do not buy or cannot afford such chairs.

SUMMARY OF THE INVENTION

The object of the invention is to provide a chair with a backrest, in which moveability corresponding to movements of a person sitting on the chair is easily effected in order equally to increase both comfort and also the supporting function.

This object is achieved with a chair as claimed in claim 1.

A chair of this type contains a subframe, a seat part supported thereon and having a seat surface and a backrest which is disposed in the region of an edge of the seat part at least approximately perpendicularly to the seat surface, and a contact surface for the back of a person sitting on the chair, wherein the chair is characterised in that the backrest is arranged in such a way that it can pivot laterally about a pivot spindle extending at least approximately perpendicularly to the contact surface of the backrest.

Preferably further alternative or individually combinable embodiments are:

- the pivot spindle extends through the contact surface and at an angle in the range of 60° to 120°, preferably 70° to 110°, particularly preferably 80° to 100°, to the perpendicular on the floor on which the chair is standing,
- the pivot spindle is disposed in the range of 0 cm to about 30 cm, preferably about 2 cm to about 15 cm, particularly preferably about 5 cm to about 7 cm, above the seat surface,
- the pivot spindle can be height-adjustable within a preset extent relative to the seat part and/or to the backrest,
- return means are provided by which the backrest is urged into a central normal position, wherein the return means have preferably linear or progressive force characteristics and/or have a preset or presettable return force,
- stopping means are provided which hold the backrest in a central normal position and allow lateral pivoting of the backrest only from a preset or presettable displacement force,
- in particular adjustable pivot limits for the lateral pivot movement of the backrest are provided, and
- armrests can be allocated to the backrest, these armrests pivoting laterally together with the backrest.

Preferred and/or advantageous embodiments of the invention and the individual aspects thereof are apparent from the present application documents as a whole.

BRIEF DESCRIPTION OF THE DRAWINGS

The invention is explained in more detail hereinunder merely by way of example with the aid of exemplified embodiments and with reference to the drawing in which.

DETAILED DESCRIPTION OF THE PREFERRED EMBODIMENTS

Figures 1, 2:
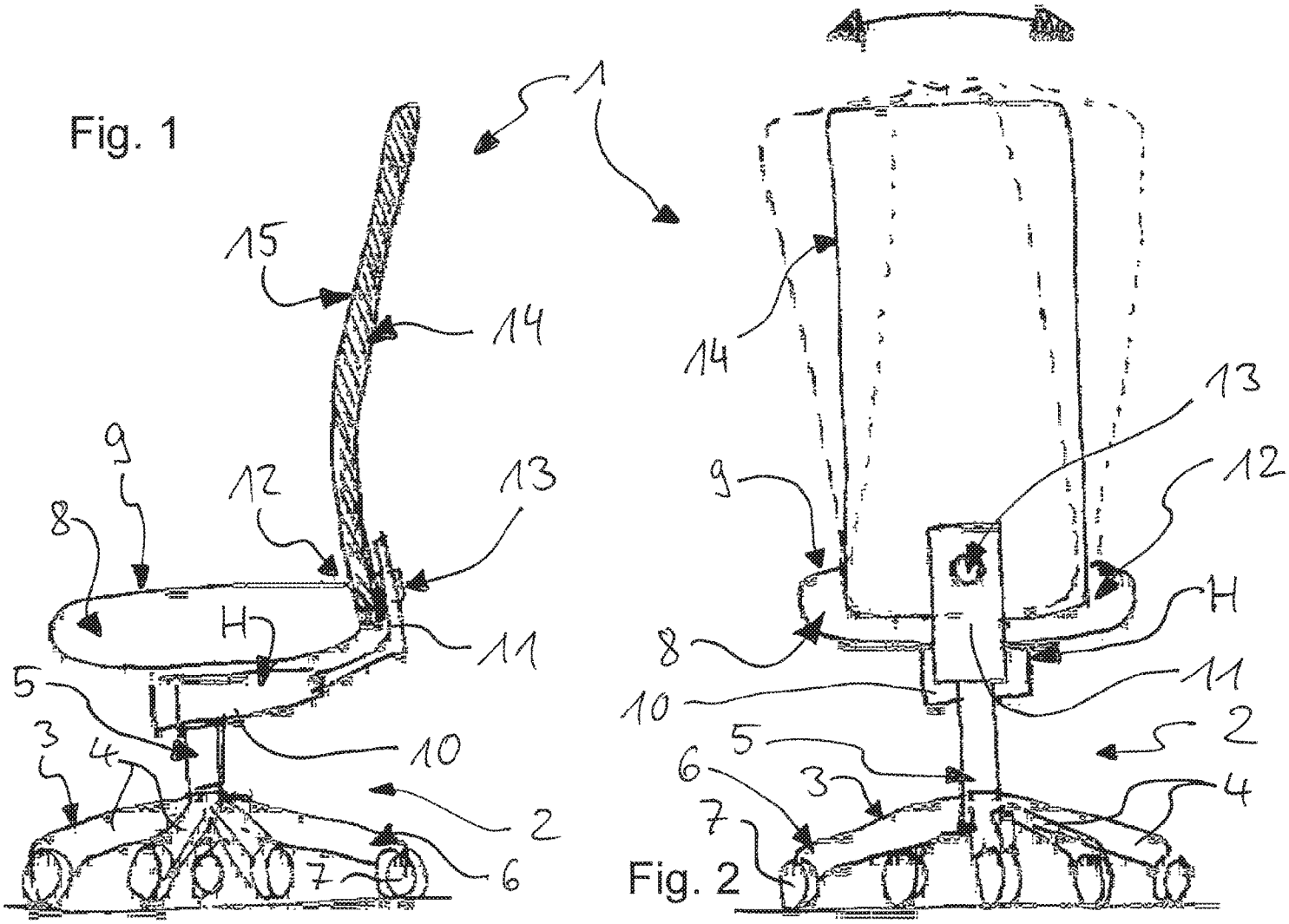
FIG. 1 illustrates a schematic side view of a first exemplified embodiment of a chair.
FIG. 2 illustrates a schematic rear view of the chair in accordance the first exemplified embodiment of FIG. 1 with the backrest in the central normal position and—in broken lines—in lateral pivot positions.

With the aid of the exemplified embodiments and examples of use described hereinunder and illustrated in the drawings, the invention is explained in more detail merely by way of example, i.e. it is not limited to these exemplified embodiments and examples of use. Method and device features will likewise also become clear from descriptions of the device and/or of the method.

Individual features which are described and/or are illustrated in conjunction with a specific exemplified embodiment are not limited to this exemplified embodiment or the combination with the remaining features of this exemplified embodiment but, within the scope of technical possibility, can be combined with any other variations even if they have not been discussed separately in the present documents.

The same reference numerals in the individual figures of the drawing relate to the same or similar components or components acting in the same or a similar manner. With the aid of the illustrations in the drawing, features will become clear which are not provided with reference signs, regardless of whether or not such features are described hereinunder.

On the other hand, features which are contained in the present description but are not visible or illustrated in the drawing, are also readily understandable to a person skilled in the art.

FIGS. 1 and 2 show a first exemplified embodiment of a chair 1, shown schematically in a side view and a rear view respectively. The chair of this first exemplified embodiment is an office swivel chair.

The chair 1 contains a subframe 2 which, in the conventional manner for office swivel chairs, has a spider 3 with five arms 4 which extend out from a common holding spindle 5 and at their free ends 6 each have a castor 7 which can pivot through 360°. A seat part 8 with a seat surface 9 is rotatably supported on the holding spindle 5 of the subframe 2 at the upper end. The type of support (not shown) can be of any known design and in particular can contain displacement means and tilting means and stopping and fixing means for the seat part 8. This manner of supporting the seat part 8 on the holding spindle 5 is not discussed in more detail hereinunder since such supports e.g. for tilting, resilient oscillation, forwards/backwards adjustments etc. are readily known to the person skilled in the art and the person skilled in the art can expediently choose, implement and use each known suitable support construction without having to be inventive himself for this purpose. Therefore, no further detail is given herein as to the design of such supports.

In the present first exemplified embodiment, a backrest holding device H is attached to the holding spindle 5 in the region of the upper end thereof, to which the seat part 8 is attached via the support (not shown), and in particular so that it rotates as a unit together with the seat part 8 on the holding spindle 5. In this first exemplified embodiment, the backrest holding device H is generally L-shaped with two limb parts, bent at an angle to one another, in the form of a subframe fastening limb 10 and of a backrest fastening limb 11. The subframe fastening limb 10 of the backrest holding device H is attached to the holding spindle 5 in the region of the upper end thereof, to which the support part 8 is attached via the support (not shown) so that the backrest holding device H rotates as a unit together with the seat part 8 and the support thereof (not shown) on the holding spindle 5. However, without limitation, the backrest holding device H could also be attached to the seat part 8 or to the support thereof (not shown).

The subframe fastening limb 10 of the backrest holding device H is of such a length that the backrest fastening limb 11 which, when the chair 1 is standing on an even floor, protrudes in an angled manner upwards therefrom, projects upwards outside an edge 12 of the seat part 8 over the seat surface 9 thereof.

A backrest 14 is attached to the backrest fastening limb 11 of the backrest holding device H via a pivot spindle 13, said backrest being disposed in the region of the edge 12 of the seat part 8 at least approximately perpendicularly to the seat surface 9, and containing a contact surface 15 for the back (not shown) of a person (not shown) sitting on the chair 1. The backrest 14 is constructed by attachment to the backrest fastening limb 11 via the pivot spindle 13 such that it can pivot laterally about the pivot spindle 13 extending at least approximately perpendicularly to the contact surface 15 of the backrest 14.

For the sake of completeness, reference is made to the fact that both the seat surface 9 and also the contact surface 15 for the back do not have to be flat, even, non-contoured surfaces. These surfaces can comprise shaping adapted to the bottom and upper limb or to the back of a person using the chair 9 merely by the shaping of the seat part 8 and backrest 14, preferably but possibly additionally by appropriate upholstery (not designated).

Insofar as directions relative to one or both of these surfaces are mentioned in the present documents, it is readily understandable to a person skilled in the art that this direction relates to a surface which, at the point for which the directional relationship is indicated, is representative of the function of the respective surface. In particular, for the direction of the pivot spindle 13 relative to the contact surface 15 of the backrest 14 this means that, expressed differently, it extends through the contact surface and at an angle in the range of 60° to 120° with respect to the perpendicular on the floor on which the chair 1 is standing when the backrest 14 is in a normal position in which it is neither pivoted laterally about the pivot spindle 13 nor displaced forwards or backwards by means of backrest tilting or oscillating means which may be provided.

The present invention, i.e. the embodiment of a chair with a pivot spindle for the backrest so that this backrest can be pivoted laterally, can be combined with all embodiments for a pivot or oscillating movement of the backrest in the forwards and backwards direction. For example, the backrest fastening limb 11 of the backrest holding device H can be formed as a moveable back rod which permits a forwards and backwards movement of the backrest, such as e.g. leaning backwards from a normal position at a defined opening angle. Corresponding devices and designs such as e.g. a synchronising mechanism, are readily known to the person skilled in the art and the person skilled in the art can expediently choose, implement and use any known suitable support construction without having to be inventive himself for this purpose. Therefore, no further detail will be given herein as to the design of such forwards and backwards mechanisms for the backrest.

In a conventional manner, the holding spindle 5 is telescopic so that the seat part 8, in particular together with the backrest 13, is height-adjustable by means thereof. This height-adjustability and resilience in the seat part 8 on the, or via the, holding spindle can be found by a person skilled in the art in any suitable construction from the prior art without having to be inventive himself for this purpose. Therefore, no further detail will be given herein as to the design of such height-adjustment capabilities for the seat part.

In the case of the chair 1 of the present invention, the pivotable arrangement of the backrest 14 on the pivot spindle 13 is important, whereby to and fro movement to the right and left is made possible when a person sitting on the chair 1 leans his/her back against the backrest. In this way, the person sitting on the chair 1 is also supported during lateral movements with his/her back against the backrest 14 and situations are avoided in which the back is unsupported at the rear during such lateral movements and the back twists and curves backwards and the edge of the backrest 14 is pressed into the back.

Return means (not shown) can be provided, by means of which a counterforce or return force is applied to the laterally pivoted backrest 14 in the direction of a central non-pivoted normal position of the backrest 14. Such return means can be directly integrated into the pivot spindle 13 or can be provided as separate means. Examples of return means are bending bars or torsion bars made from spring steel acting on both sides or compression springs acting on one side, rubber blocks and many similar means. These return means have the advantage that they support the upright positioning of the person sitting on the chair 1 from a laterally bent position into an upright position corresponding to the normal position of the backrest.

A further advantage can be provided in that the return means have preferably linear or progressive force characteristics, whereby adaptation to specific usage requirements and individual users is possible. For this purpose, it is also advantageously possible to make provision for the return means to have a preset or presettable return force, which can be achieved e.g. in the case of the use of a bending bar made from spring steel by adjusting the effective length thereof. A further advantageous embodiment consists of the return means being such that when the backrest is pivoted but unloaded a damped return of the backrest to the normal position takes place. By means of the return means it is also possible e.g. to control how far and how lightly or strongly the backrest 14 can be rotated to the right or left about the pivot spindle 13.

Alternatively or additionally, stopping means (not shown) can also be provided which hold the backrest 14 in particular in the central normal position (shown in FIG. 2 by a continuous line) and which permit lateral pivoting of the backrest 14 only from a preset or presettable displacement force. It is therefore possible to avoid the backrest 14 also carrying out such lateral movements during small slight lateral movements of a person sitting on the chair 1. Instead of this, increased stability and supporting function for the back of the person sitting on the chair 1 during slight lateral movements are achieved. Stopping means can preferably have an individually adjustable separation force and/or a pivot position of the backrest 14 can also be provided or be adjustable.

A further advantageous design consists in particular of adjustable pivot limits (not shown) for the lateral pivot movement of the backrest 14. Therefore, overloading of pivot spindle 13 and/or return means can be avoided as can the risk of the stability of the chair 1 no longer being assured by reason of excessive pivoting of the backrest 14 and therefore of a person sitting on the chair 1. Such pivot limits can be produced e.g. by simple bushes or rubber stoppers.

Depending on the design of the rest of the chair 1, the pivot spindle 13 can also be anchored e.g. in the seat part 8. However, it is preferred if the pivot spindle is disposed in the range of 0 cm to about 30 cm, preferably about 2 cm to about 15 cm, particularly preferably about 5 cm to about 7 cm, above the seat surface. In conjunction therewith, for individual adaptation of the chair 1 to a specific user, provision can advantageously be made for the pivot spindle 13 to be height-adjustable within a preset extent relative to the seat part 8 and/or to the backrest 14. The adjustability of the vertical or height position of the pivot spindle 13 and/or backrest 14 can be achieved e.g. by a snap mechanism, a stoppable latching arrangement, a magnet or a friction element to fix the position of the pivot spindle 13 and/or backrest 14 in one of a plurality of height positions.

A further advantageous embodiment consists of armrests (not shown) being allocated to the backrest 14, these armrests pivoting laterally together with the backrest 14. It is thereby advantageously achieved that desired/provided armrests are not in the way during lateral movement of the person sitting on the chair 1 and do not e.g. press into the side of this person but rather "dip" so to speak. The connection of armrests to the backrest 14 can also be detachable, reversible or interchangeable in order also to provide the user with the option of "lolling" in the chair during lateral pivoting of the backrest 14 and thus to use the stationary armrest as a support.

Figure 4:
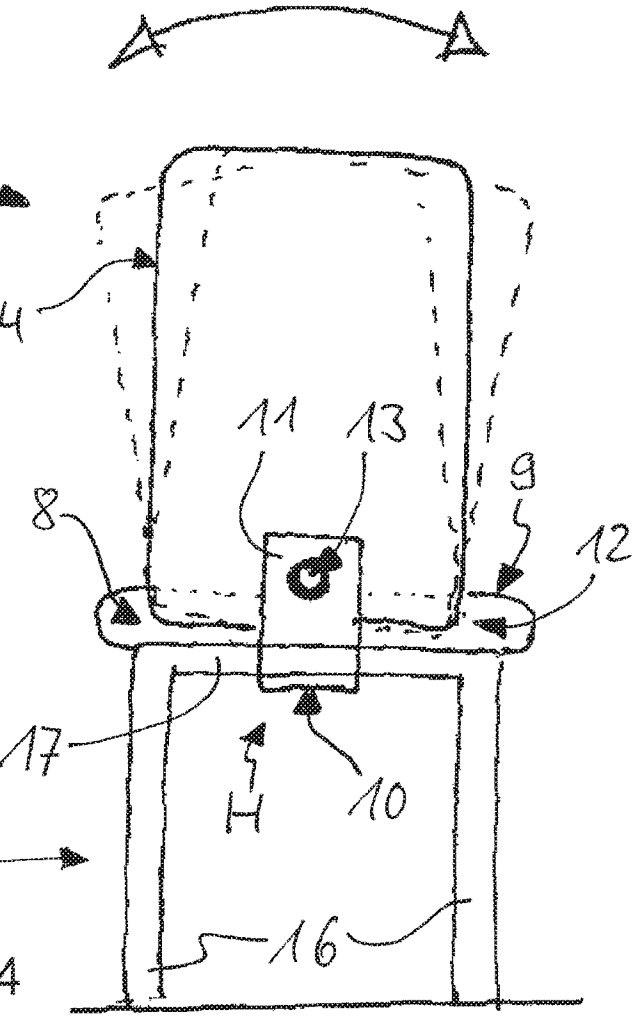
FIG. 4 illustrates a schematic rear view of the chair in accordance the second exemplified embodiment of FIG. 3 with the backrest in the central normal position and—in broken lines—in lateral pivot positions.
Figure 3:
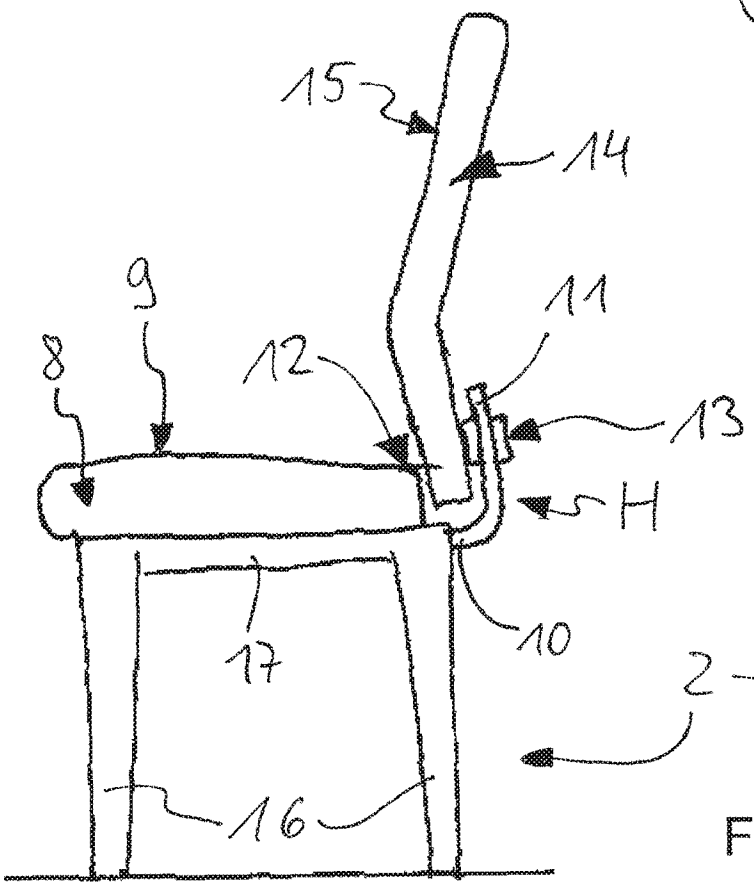
FIG. 3 illustrates a schematic side view of a second exemplified embodiment of a chair.

FIGS. 3 and 4 show a second exemplified embodiment of a chair 1 schematically in each case in a side view and in a rear view. The chair 1 of this second exemplified embodiment is a waiting area chair, conference chair or dining chair or the like which is rigid in comparison to the moveable, rotatable, forwards/backwards pivotable office chair and which can also be designed as a so-called "cantilever chair".

With respect to the first exemplified embodiment, in the second exemplified embodiment the same or similar components or components acting in the same or a similar manner are each provided with the same reference signs.

Only the aspects with respect to which the second exemplified embodiment differs from the first exemplified embodiment will be discussed hereinunder. In particular, all possible embodiments, variations, modifications, substitutions and combinations which have been illustrated and explained in conjunction with the first exemplified embodiment are also possible in the case of the corresponding parts and components of the second exemplified embodiment, and corresponding repetitive statements in relation thereto have been omitted for the sake of clarity.

In the chair 1 of the second exemplified embodiment, the subframe 2 is formed from four chair legs 16 with holding bars 17 extending therebetween at the top, upon which the seat part 8 with the seat surface 9 is fixedly attached in a conventional manner. However, the subframe 2 can e.g. also be of a tubular construction according to the principle of the "cantilever chair" or any other construction.

The backrest holding device H is attached to the construction consisting of chair legs 16 and holding bars 17 extending therebetween at the top and/or to the seat part 8, this backrest holding device, as in the case of the first exemplified embodiment, generally having an L-shape with two limb parts which are angled with respect to each other and in the form of the subframe fastening limb 10 and of the backrest fastening limb 11. The subframe fastening limb 10 of the backrest holding device H is attached to the construction consisting of chair legs 16 and holding bars 17 extending therebetween at the top and/or to the seat part 8.

The subframe fastening limb 10 of the backrest holding device H is of such a length that the backrest fastening limb 11 which, when the chair 1 is standing on an even floor, protrudes in an angled manner upwards therefrom, projects upwards outside an edge 12 of the seat part 8 over the seat surface 9 thereof.

The backrest 14 is attached to the backrest fastening limb 11 of the backrest holding device H via a pivot spindle 13, said backrest being disposed in the region of the edge 12 of the seat part 8 at least approximately perpendicularly to the seat surface 9, and containing the contact surface 15 for the back (not shown) of a person (not shown) sitting on the chair 1. The backrest 14 is constructed by attachment to the backrest fastening limb 11 via the pivot spindle 13 such that it can pivot laterally about the pivot spindle 13 extending at least approximately perpendicularly to the contact surface 15 of the backrest 14. In other words, the pivot spindle 13 is disposed relative to the contact surface 15 of the backrest 14 so that it extends through the contact surface and at an angle in the range of 60° to 120° with respect to the perpendicular on the floor on which the chair 1 is standing when the backrest 14 is in a normal position in which it is neither pivoted laterally about the pivot spindle 13 nor displaced forwards or backwards by means of backrest tilting or oscillating means which may be provided.

The backrest holding device H in this second exemplified embodiment, as also in the case of the first exemplified embodiment explained previously with reference to FIGS. 1 and 2, can itself be formed in an elastic manner e.g. from sufficiently strong spring steel in order to achieve the flexibility of the backrest 14 in the backwards direction with respect to a person sitting on the chair 1.

By means of the pivot spindle 13, on the one hand, the subframe 2, together with the seat part 8, and, on the other hand, the backrest 14 are connected to one another in an articulated manner such that the backrest 14 can be pivoted with respect to the seat part 8 laterally about the pivot spindle 13.

For this purpose, the pivot spindle 13 is arranged such that it pivotably mounts the backrest 14 slightly above the seat height i.e. the seat surface 9, relative to the subframe 2 and the seat part 8 so that defined lateral to and fro oscillation of the backrest 14 about the pivot spindle 13 is made possible.

Insofar as the present documents relate to a pivot spindle 13, no mathematical axis is meant but rather a pivot joint which can be produced by a slide bearing, ball bearing or the like. Other possible constructions for the pivot joint are a piece of rubber or other elastic material which, in particular by shaping and/or reinforcement with inlays, is formed in such a way that a substantial movement capability exists only in said lateral directions for the pivoting of the backrest 14 in accordance with the invention, or a spring steel element or the like, whereby then at the same time the return means are functionally incorporated into the pivot spindle 13.

The pivot spindle 13 can also be formed in such a way or be provided with additional means such that a counterforce can therefore be set against pivoting of the backrest 14, which permits adaptation to individual requirements of specific users. Such means for setting a counterforce against pivoting of the backrest 14 can be e.g. rubber elements with friction with can be set by crimping.

Depending on space available and design wishes, the pivot spindle 13 can be disposed in front of, within or behind the backrest 14. For example, the pivot spindle 13 can also be concealed within or below upholstery (not designated) of the backrest 14.

A further preferred embodiment consists of the backrest 14 having a maximum width of about 25 cm to about 40 cm, preferably about 28 cm to about 35 cm, in particular about 30 cm.

The invention is presented with the aid of the exemplified embodiments in the description and in the drawing merely by way of example and is not limited thereto but rather includes all variations, modifications, substitutions and combinations which the person skilled in the art can derive from the present documents in particular within the scope of the claims and of the general presentations in the introduction to this description and of the description of the exemplified embodiments and can combine with his specialist knowledge in the art and the prior art. In particular, all individual features and design possibilities of the invention can be combined.

What is claimed is:

1. An office chair comprising a subframe having a holding spindle and a spider, a seat part supported thereon and having a seat surface, a backrest which is disposed in a region of an edge of the seat part at least substantially perpendicularly to the seat surface and comprises a contact surface for a back of a person sitting on the office chair; and a pivot spindle extending at least substantially perpendicularly through the contact surface of the backrest, wherein the backrest rotates about the pivot spindle, and wherein the pivot spindle is disposed in a range of 0° cm to about 30° cm above the seat surface.

2. The office chair as claimed in claim 1, wherein the pivot spindle extends through the contact surface at an angle in a range of 60° to 120°, or at the angle of 70° to 110°, or at the angle 80° to 100°, to a perpendicular to a floor on which the office chair is standing.

3. The office chair as claimed in claim 1, wherein the pivot spindle is disposed in the range of about 2 cm to about 15 cm, or in the range of about 5 cm to about 7 cm, above the seat surface.

4. The office chair as claimed in claim 1, wherein the pivot spindle is height-adjustable within a preset extent relative to the seat part and/or to the backrest.

5. The office chair as claimed in claim 1, further comprising return means by which the backrest is urged into a central normal position, wherein the return means comprise linear or progressive force characteristics and/or have a preset or presettable return force.

6. The office chair as claimed in claim 1, further comprising stopping means which hold the backrest in a central normal position and allow lateral pivoting of the backrest only from a preset or presettable displacement force.

7. The office chair as claimed in claim 1, further comprising adjustable pivot limits for the lateral pivot movement of the backrest.

8. The office chair as claimed in claim 2, wherein the pivot spindle is disposed in the range of about 2 cm to about 15 cm, or in the range of about 5 cm to about 7 cm, above the seat surface.

9. The office chair as claimed in claim 2, wherein the pivot spindle is height-adjustable within a preset extent relative to the seat part and/or to the backrest.

10. The office chair as claimed in claim 3, wherein the pivot spindle is height-adjustable within a preset extent relative to the seat part and/or to the backrest.

11. The office chair as claimed in claim 8, wherein the pivot spindle is height-adjustable within a preset extent relative to the seat part and/or to the backrest.

12. The office chair as claimed in claim 2, further comprising return means by which the backrest is urged into a central normal position, wherein the return means comprise linear or progressive force characteristics and/or have a preset or presettable return force.

13. The office chair as claimed in claim 3, further comprising return means by which the backrest is urged into a central normal position, wherein the return means comprise linear or progressive force characteristics and/or have a preset or presettable return force.

14. The office chair as claimed in claim 8, further comprising return means by which the backrest is urged into a central normal position, wherein the return means comprise linear or progressive force characteristics and/or have a preset or presettable return force.

15. The office chair as claimed in claim 2, further comprising stopping means which hold the backrest in a central normal position and allow lateral pivoting of the backrest only from a preset or presettable displacement force.

16. The office chair as claimed in claim 3, further comprising stopping means which hold the backrest in a central normal position and allow lateral pivoting of the backrest only from a preset or presettable displacement force.

17. The office chair as claimed in claim 8, further comprising stopping means which hold the backrest in a central normal position and allow lateral pivoting of the backrest only from a preset or presettable displacement force.

18. The office chair as claimed in claim 2, further comprising adjustable pivot limits for the lateral pivot movement of the backrest.

19. The office chair as claimed in claim 3, further comprising adjustable pivot limits for the lateral pivot movement of the backrest.

20. The office chair as claimed in claim 8, further comprising adjustable pivot limits for the lateral pivot movement of the backrest.

* * * * *